US009648690B1

(12) United States Patent
Chou et al.

(10) Patent No.: US 9,648,690 B1
(45) Date of Patent: May 9, 2017

(54) DIMMABLE INSTANT-START BALLAST

(71) Applicant: Delta Electronics, Inc., Taoyuan (TW)

(72) Inventors: Ching-Ho Chou, Taoyuan (TW); Yung-Chuan Lu, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 15/141,419

(22) Filed: Apr. 28, 2016

(30) Foreign Application Priority Data

Nov. 13, 2015 (TW) ..... 104137468 A

(51) Int. Cl.

| | |
|---|---|
| ***H05B 37/02*** | (2006.01) |
| ***H05B 33/08*** | (2006.01) |
| ***H05B 41/392*** | (2006.01) |
| ***H05B 41/298*** | (2006.01) |

(52) U.S. Cl.
CPC ..... *H05B 33/0845* (2013.01); *H05B 33/0815* (2013.01); *H05B 33/0887* (2013.01); *H05B 37/02* (2013.01); *H05B 41/2983* (2013.01); *H05B 41/3921* (2013.01)

(58) Field of Classification Search
CPC ..... H05B 33/08; H05B 37/02; H05B 41/16; H05B 41/36
USPC ..... 315/219, 224, 294, 307, 312
See application file for complete search history.

(56) References Cited

U.S. PATENT DOCUMENTS

2008/0309244 A1* 12/2008 Hsu ..... H05B 41/2828 315/219
2009/0096391 A1* 4/2009 Notohamiprodjo H05B 41/2828 315/307
2010/0244726 A1* 9/2010 Melanson ..... H02M 3/33523 315/291
2013/0009559 A1* 1/2013 Niikura ..... H05B 33/0845 315/201
2013/0300310 A1* 11/2013 Hu ..... H05B 33/0854 315/239

FOREIGN PATENT DOCUMENTS

| | | |
|---|---|---|
| CN | 1929277 A | 3/2007 |
| TW | 201110820 A | 3/2011 |
| TW | 201244544 A | 11/2012 |
| TW | 201334621 A | 8/2013 |

OTHER PUBLICATIONS

Taiwanese Office Action dated Jul. 25, 2016 in application No. 104137468; pp. 1-4.

* cited by examiner

*Primary Examiner* — Tung X Le
(74) *Attorney, Agent, or Firm* — Muncy, Geissler, Olds & Lowe, P.C.

(57) ABSTRACT

A dimmable instant-start ballast for a plurality of LED lamps and/or a plurality of fluorescent lamps is provided, which includes an isolated dimming interface, a duty control device, a dimming switch, and an inverter circuit. The isolated dimming interface receives a dimming signal to generate a dimming voltage. The duty control device generates an operation signal according to the dimming voltage. The dimming switch periodically couples a first node to a ground according to the operation signal. The inverter circuit receives a rectified voltage and is coupled to the first node. When the first node is coupled to the ground terminal, the inverter circuit provides a lamp current for the LED lamps and/or the fluorescent lamps.

14 Claims, 6 Drawing Sheets

DIMMABLE INSTANT-START BALLAST

CROSS REFERENCE TO RELATED APPLICATIONS

This Application claims priority of Taiwan Patent Application No. 104137468, filed on Nov. 13, 2015, the entirety of which is incorporated by reference herein.

BACKGROUND OF THE INVENTION

Field of the Invention

The disclosure relates generally to a dimmable instant-start ballast, and more particularly it relates to a dimmable instant-start ballast with a wide dimming range.

Description of the Related Art

Nowadays, most dimmable instant-start ballasts for fluorescent lamps cannot dim the fluorescent lamps under 50%. The main cause is that the temperature of the fluorescent lamps would not be high enough for the fluorescent lamps to remain in normal operation. A quick solution for this problem is to provide additional preheating energy for the fluorescent lamp. Therefore, most of the dimmable ballasts that are available nowadays are the rapid-start type, or are a programmed-start type for deep dimming.

In addition, since a fluorescent lamp is able to be directly replaced by an LED lamp nowadays, as LED lamps are advantageous in terms of saving power compared to the fluorescent lamps, an instant-start ballast for deep dimming which is able to simultaneously drive LED lamps and fluorescent lamps is required.

BRIEF SUMMARY OF THE INVENTION

For solving the problems described above, the invention provides a dimmable instant-start ballast with a wide dimming range, in which the minimum dimming level can be adjusted.

In an embodiment, a dimmable instant-start ballast for a plurality of LED lamps and/or a plurality of fluorescent lamps comprises an isolated dimming interface, a duty control device, a dimming switch, and an inverter circuit. The isolated dimming interface receives a dimming signal to generate a dimming voltage. The duty control device generates an operation signal according to the dimming voltage. The dimming switch periodically couples a first node to a ground terminal according to the operation signal. The inverter circuit receives a rectified voltage and is coupled to the first node. The inverter circuit generates a lamp current to the LED lamps and/or the fluorescent lamps when the first node is coupled to the ground terminal.

According to an embodiment of the invention, the dimming switch periodically operates in a conductive state and an non-conductive state according to a duty cycle of the operation signal. The first node is coupled to the ground terminal and the inverter circuit generates the lamp current when the dimming switch operates in the conductive state. The first node is not coupled to the ground terminal and the inverter circuit does not generate the lamp current when the dimming switch operates in the non-conductive state. The lamp current flows through the LED lamps and/or the fluorescent lamps to generate an illumination brightness, wherein the illumination brightness is proportional to the duty cycle.

According to an embodiment of the invention, the isolated dimming interface comprises two control terminals, a miswiring protection device, a first half-wave rectifier, and an isolated transformer. Two control terminals receive the dimming signal generated by an external dimming device. The miswiring protection device is coupled to the control terminals and configured to provide miswiring protection.

The first half-wave rectifier is coupled to the miswiring protection device. The isolated transformer comprises a primary side and a secondary side, in which the primary side receives a first current, and the secondary side is coupled to the first half-wave rectifier. The isolated transformer maps the first current of the primary side to the secondary side, and maps the impedance of the secondary side to the primary side to generate the dimming voltage at the primary side.

According to an embodiment of the invention, the external dimming device is a DC voltage source, a resistive element, or a dimmer. The dimming signal is a DC voltage value of the DC voltage source or a resistive value of the resistive element.

According to an embodiment of the invention, the duty control device comprises a voltage regulator, a duty control signal generator, and a switch-driving circuit. The voltage regulator generates a DC supply voltage according to the rectified voltage. The duty control signal generator receives the DC supply voltage and comprises a triangle-wave generating circuit, a clamp circuit, and a comparator. The triangle-wave generating circuit is configured to generate a triangle-wave signal. The clamp circuit rectifies the dimming voltage to be a DC dimming voltage and provides a maximal one between the DC dimming voltage and a reference voltage for a comparison node. The comparator compares the voltage of the comparison node with the triangle-wave signal to generate a duty control signal. The switch-driving circuit receives the DC supply voltage and generates the operation signal according to the duty control signal.

According to an embodiment of the invention, the clamp circuit further comprises a second half-wave rectifier and a diode. The second half-wave rectifier converts the dimming voltage to the DC dimming voltage and providing the DC dimming voltage for the comparison node. The diode receives the reference voltage. The diode is turned ON to provide the reference voltage for the comparison node when the reference voltage exceeds the DC dimming voltage, such that the duty cycle is not less than a predetermined value. The diode is turned OFF when the reference voltage does not exceed the DC dimming voltage.

According to an embodiment of the invention, the isolated dimming interface further comprises a voltage-drop device. The voltage-drop device is coupled between the first half-wave rectifier and the secondary side and configured to raise the voltage level of the DC dimming voltage, such that the illumination brightness is proportional to the dimming signal.

According to an embodiment of the invention, the inverter circuit is a push-pull resonant converter or a half-bridge resonant converter.

According to an embodiment of the invention, the dimmable instant-start ballast further comprises a rectifier. The rectifier receives an AC voltage to generate the rectified voltage.

In an embodiment, a dimmable control device for controlling an inverter circuit to periodically generate a lamp current to a plurality of LED lamps and/or a plurality of fluorescent lamps comprises an isolated dimming interface, a voltage regulator, a duty control signal generator, and a dimming switch. The isolated dimming interface receives a dimming signal to generate a dimming voltage. The voltage regulator generates a DC supply voltage. The duty control signal generator receives the DC supply voltage and comprises a triangle-wave generating circuit, a clamp circuit, and a comparator. The triangle-wave generating circuit generates a triangle-wave signal. The clamp circuit rectifies the dimming voltage to a DC dimming voltage and provides a maximal one between the DC dimming voltage and a reference voltage for a comparison node. The comparator compares the voltage of the comparison node with the triangle-wave signal to generate a duty control signal. The switch-driving circuit receives the DC supply voltage and generates an operation signal according to the duty control signal. The dimming switch periodically turns ON, according to the operation signal, to couple the inverter circuit to the ground terminal, such that the inverter circuit periodically generates the lamp current.

According to an embodiment of the invention, the dimming switch periodically operates in a conductive state and an non-conductive according to the operation signal. The inverter circuit generates the lamp current when the dimming switch operates in the conductive state, and the inverter circuit does not generate the lamp current when the dimming switch operates in the non-conductive state. The lamp current flows through the LED lamps and/or the fluorescent lamps to generate an illumination brightness. The illumination brightness is proportional to a duty cycle of the operation signal.

According to an embodiment of the invention, the isolated dimming interface comprises two control terminals, a miswiring protection device, a first half-wave rectifier, and an isolated transformer. Two control terminals receive the dimming signal generated by an external dimming device. The miswiring protection device is coupled to the control terminals and configured to provide miswiring protection.

The first half-wave rectifier is coupled to the miswiring protection device. The isolated transformer comprises a primary side and a secondary side, in which the primary side receives a first current, and the secondary side is coupled to the first half-wave rectifier. The isolated transformer maps the first current of the primary side to the secondary side and maps the impedance of the secondary side to the primary side. The dimming voltage is generated at the primary side.

According to an embodiment of the invention, the external dimming device is a DC voltage source, a resistive element, or a dimmer, wherein the dimming signal is a DC voltage value of the DC voltage source or a resistive value of the resistive element.

According to an embodiment of the invention, the clamp circuit further comprises a second half-wave rectifier and a diode. The second half-wave rectifier converts the dimming voltage to the DC dimming voltage and provides the DC dimming voltage for the comparison node. The diode receives the reference voltage. The diode is turned ON to provide the reference voltage for the comparison node when the reference voltage exceeds the DC dimming voltage, such that the duty cycle is not less than a predetermined value. The diode is turned OFF when the reference voltage does not exceed the DC dimming voltage.

According to an embodiment of the invention, the isolated dimming interface further comprises a voltage-drop device. The voltage-drop device is coupled between the first half-wave rectifier and the secondary side and configured to raise the voltage level of the DC dimming voltage, such that the illumination brightness is proportional to the dimming signal.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
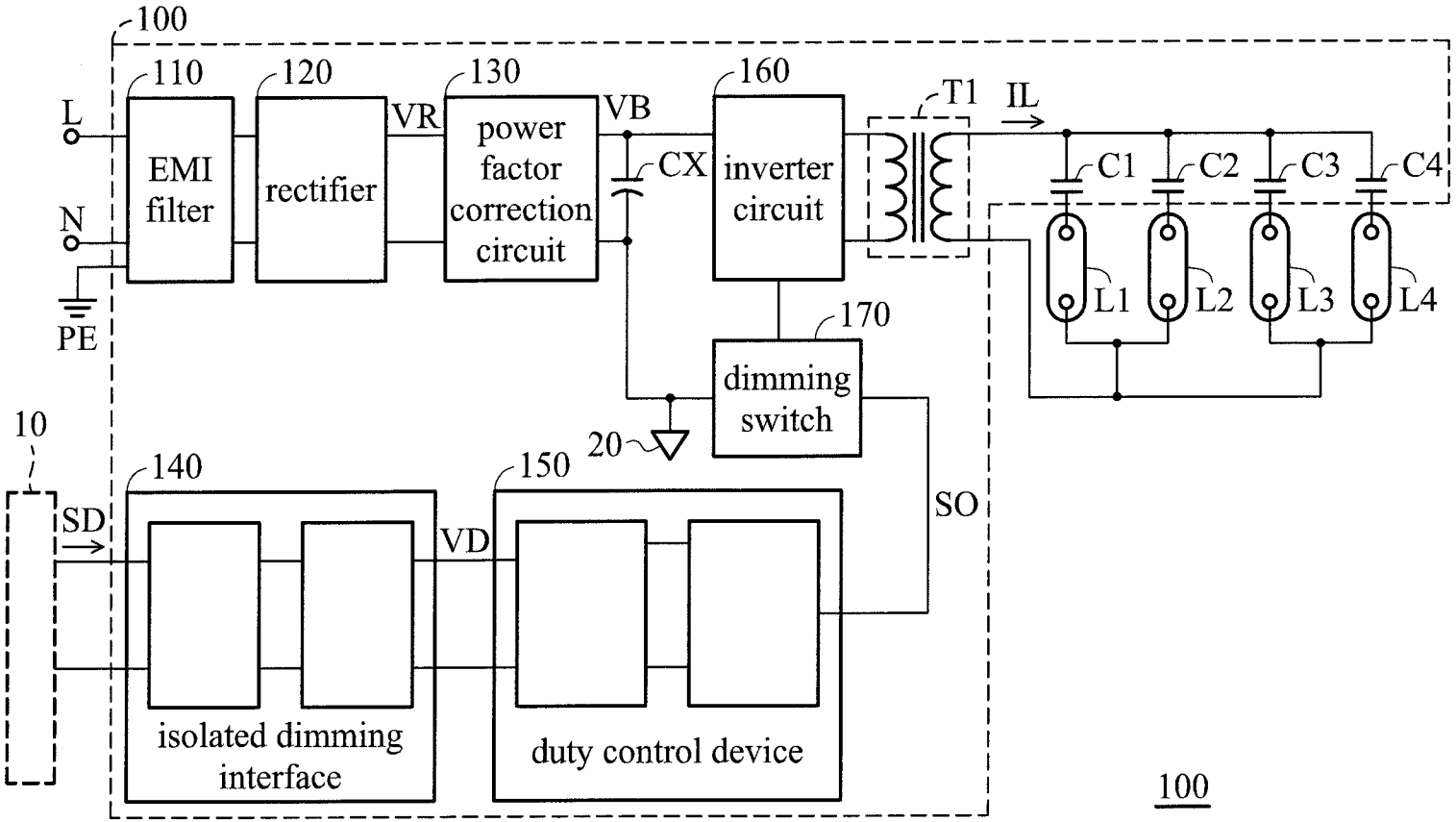
FIG. 1 is a block diagram of the dimmable instant-start ballast in accordance with an embodiment of the invention.

FIG. 1 is a block diagram of the dimmable instant-start ballast in accordance with an embodiment of the invention. As shown in FIG. 1, the dimmable instant-start ballast 100 includes the EMI filter 110, the rectifier 120, the power factor correction (PFC) circuit 130, the isolated dimming interface 140, the duty control device 150, the inverter circuit 160, the dimming switch 170, the first capacitor C1, the second capacitor C2, the third capacitor C3, and the fourth capacitor C4.

The dimmable instant-start ballast 100 is configured to receive the AC supply power and the dimming-control signal, and periodically provides the lamp current IL for the first lamp L1, the second lamp L2, the third lamp L3, and the fourth lamp L4 according to the dimming-control signal. The first lamp L1, the second lamp L2, the third lamp L3, and the fourth lamp L4 are respectively coupled to the first capacitor C1, the second capacitor C2, the third capacitor C3, and the fourth capacitor C4 of the dimmable instant-start ballast 100 in parallel. According to an embodiment of the invention, the AC supply power received by the dimmable instant-start ballast 100 is the commercial power 120 Vac or 277 Vac.

According to an embodiment of the invention, the first lamp L1, the second lamp L2, the third lamp L3, and the fourth lamp L4 are all fluorescent lamps. According to another embodiment of the invention, the first lamp L1, the second lamp L2, the third lamp L3, and the fourth lamp L4 are any combination of LED lamps and fluorescent lamps. According to an embodiment of the invention, the first lamp L1, the second lamp L2, the third lamp L3, and the fourth lamp L4 are illustrated herein, but they are not limited to the quantity indicated.

EMI filter 110, which receives the AC supply voltage, is configured to reduce the EMI generated by the dimmable instant-start ballast 100. The rectifier 120 converts the AC supply voltage received by the EMI filter 110 to the rectified voltage VR. The PFC circuit 130, is coupled to the rectifier 120, is configured to correct the power factor of the dimmable instant-start ballast 100 and to generate the boost voltage VB by the received rectified voltage VR. According to an embodiment of the invention, the PFC circuit 130 is a boost circuit, which boosts the rectified voltage VR to the boost voltage VB and stores the boost voltage VB across the regulated capacitor CX. According to another embodiment of the invention, the PFC circuit 130 could be omitted from the dimmable instant-start ballast 100.

The isolated dimming interface 140 receives the dimming signal SD to generate the dimming voltage VD, and the duty control device 150 generates the operation signal SO according to the dimming voltage VD. According to an embodiment of the invention, the inverter circuit 160 is supplied by the boost voltage VB and is coupled to the ground 20 through the dimming switch 170. When the inverter circuit 160 is periodically coupled to the ground 20 through the dimming switch 170 according to the operation signal SO, the inverter circuit 160 periodically provides the lamp current IL for the first lamp L1, the second lamp L2, the third lamp L3, and the fourth lamp L4 through the first transformer T1 to achieve the purpose of power reduction.

According to another embodiment of the invention, the PFC circuit 130 is omitted from the dimmable instant-start ballast 100. The inverter circuit 160 receives the rectified voltage VR generated by the rectifier 120 and provides the lamp current IL for the first lamp L1, the second lamp L2, the third lamp L3, and the fourth lamp L4 according to the periodically turned-on dimming switch 170. According to an embodiment of the invention, the inverter circuit 160 could be a push-pull parallel resonant converter; according to another embodiment of the invention, the inverter circuit 160 could be a half-bridge parallel resonant converter.

Figure 2:
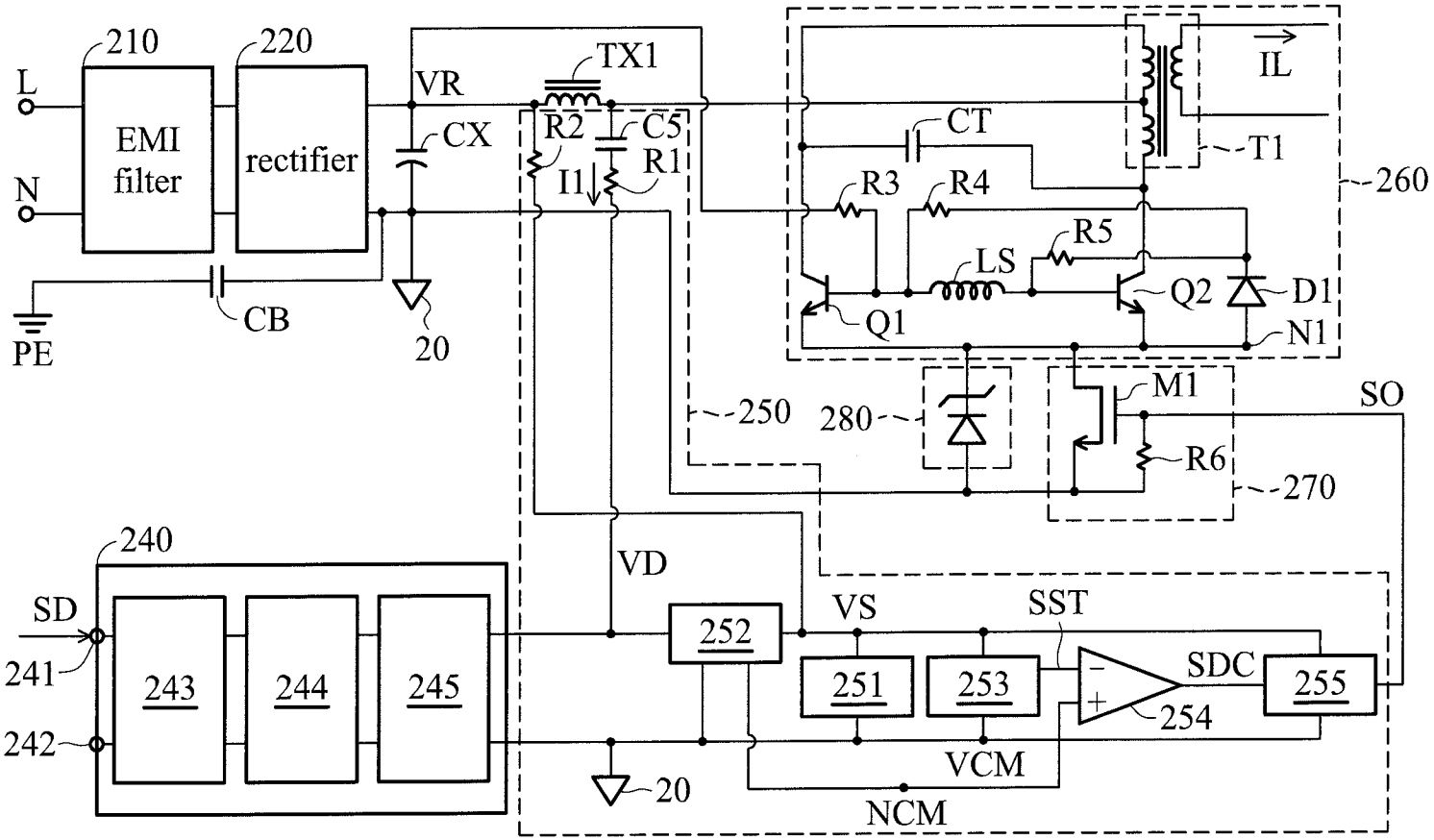
FIG. 2 is a schematic diagram of the dimmable instant-start ballast in accordance with an embodiment of the invention.

FIG. 2 is a schematic diagram of the dimmable instant-start ballast in accordance with an embodiment of the invention. As shown in FIG. 2, the dimmable instant-start ballast 200 includes EMI filter 210, the rectifier 220, the isolated dimming interface 240, the duty control device 250, the inverter circuit 260, the dimming switch 270, and the protection device 280. Compared with FIG. 1, the dimmable instant-start ballast 200 is the same as the dimmable instant-start ballast 100 in FIG. 1 regardless of the PFC circuit being omitted from the dimmable instant-start ballast 200.

As shown in FIG. 2, the EMI filter 210 receives the AC voltage supplied by the live wire L and the neutral wire N of the AC supply power. After the EMI filter 210 reduces the EMI generated by the dimmable instant-start ballast 200, the rectifier 220 converts the AC supply voltage received by the EMI filter 210 to the rectified voltage VR which is stored in the regulated capacitor CX. The regulated capacitor CX is coupled to the ground 20 which is isolated from the protective earth PE by the isolation capacitor CB. According to an embodiment of the invention, the rectified voltage VR might be regarded as a DC voltage.

The isolated dimming interface 240 includes the first control terminal 241, the second control terminal 242, the miswiring protection device 243, the first half-wave rectifier 244, and the isolated transformer 245, in which the first control terminal 241 and the second control terminal 242 are configured to receive the dimming signal SD generated by the external dimming device 10 in FIG. 1. According to an embodiment of the invention, the external dimming device 10 in FIG. 1 is a DC voltage source, and the generated dimming signal SD is a DC voltage ranging from 0V to 10V. According to another embodiment of the invention, the external dimming device 10 in FIG. 1 is a resistive element with a variable resistance. According to yet another embodiment of the invention, the external dimming device 10 in FIG. 10 is a dimmer.

According to an embodiment of the invention, the miswiring protection device 243 is configured to provide the miswiring protection when the first control terminal 241 and the second control terminal 242 are coupled to the AC supply power. The first half-wave rectifier 244 is coupled to the miswiring protection device. The isolated transformer 245 includes a primary side and a secondary side, in which the primary side receives the first current I1 generated by the fifth capacitor C5 and the first resistor R1 and the secondary side of the isolated transformer 245 is coupled to the first half-wave rectifier 244. The first current I1 received by the primary side is mapped to the secondary side by the isolated transformer 245 and then rectified to be a DC current. The isolated transformer 245 further maps the impedance of the secondary side to the primary side, and the dimming signal VD is therefore generated. The function of the isolated dimming interface 240 will be described in detail in the following description.

The duty control device 250 includes the voltage regulator 251, the clamp circuit 252, the triangle-wave generating circuit 253, the comparator 254, the switch-driving circuit 255, the fifth capacitor C5, the first resistor R1, and the second resistor R2. The voltage regulator 251 regulates the DC voltage generated by the rectified voltage VR and the first coil TX1 to be the DC supply voltage VS. The DC supply voltage VS is configured to supply the clamp circuit 252, the triangle-wave generating circuit 253, the comparator 254, and the switch-driving circuit 255.

According to an embodiment of the invention, the rectified voltage VR and the second resistor R2 are configured to generate an initial value of the DC supply voltage VS, in order to enable the duty control circuit 250. The clamp circuit 252 rectifies the dimming voltage VD to be a DC dimming voltage, and generates the reference voltage VREF (not shown in FIG. 2) by using of the DC supply voltage VS. The clamp circuit 252 provides the maximal one between the DC dimming voltage, which is generated by rectifying the dimming voltage VD, and the reference voltage VREF for the comparison node NCM. The clamp circuit 252 and the reference voltage VREF will be described in detail in the following description.

The triangle-wave generating circuit 253 is configured to generate the triangle-wave signal SST. The comparator 254 is configured to compare the comparison voltage VCM of the comparison node NCM with the triangle-wave signal SST to generate the duty control signal SDC, in which the duty control signal SDC has the duty cycle D. According to an embodiment of the invention, the triangle-wave generating circuit 253 generates the triangle-wave signal SST by charging and discharging a capacitor.

The switch-driving circuit 255 generates the operation signal SO according to the duty control signal SDC generated by the comparator 254, in which the operation signal SO is configured to control the dimming switch 270 periodically operate in the conductive state and the non-conductive state. According to an embodiment of the invention, the duty control signal SDC and the operation signal SO have the same duty cycle D. According to an embodiment of the invention, the frequency of the duty control signal SDC and the operation signal SO exceeds 200 Hz.

According to an embodiment of the invention, the inverter circuit 260 is a push-pull parallel resonant converter. The inverter circuit 260 is coupled to the first node N1, and receives a fixed current generated by the first coil TX1 to generate the lamp current IL to the first lamp L1, the second lamp L2, the third lamp L3, and the fourth lamp L4 in FIG. 1 through the first transformer T1, in which the first node N1 is coupled to the ground 20 through the dimming switch 270. According to an embodiment of the invention, when the dimming switch 270 operates in the conductive state according to the operation signal SO, the inverter circuit 260 generates the lamp current IL to the first lamp L1, the second lamp L2, the third lamp L3, and the fourth lamp L4 in FIG. 1 through the first transformer T1.

According to another embodiment of the invention, when the dimming switch 270 operates in the non-conductive state according to the operation signal SO, the inverter circuit 260 stops generating the lamp current IL. According to an embodiment of the invention, when the lamp current IL flows through the first lamp L1, the second lamp L2, the third lamp L3, and the fourth lamp L4 in FIG. 1, each of the first lamp L1, the second lamp L2, the third lamp L3, and the fourth lamp L4 generates an illumination brightness, in which the generated illumination brightness is proportional to the duty cycle D. According to an embodiment of the invention, a voltage surge is generated during the dimming switch 270 altering between the conductive state and the non-conductive state. The protection device 280 could suppress the magnitude of the voltage surge, to protect the dimming switch 270. According to an embodiment of the invention, the protection device 280 is a transient voltage suppressor (TVS) or a zener diode.

The inverter circuit 260 further includes the first bipolar junction transistor Q1, the second bipolar junction transistor Q2, the third resistor R3, the fourth resistor R4, the fifth resistor R5, the driving coil LS, the first diode D1, the resonant capacitor CT, and the first transformer T1. According to an embodiment of the invention, the third resistor R3 is configured to activate the first bipolar junction transistor Q1 or the second bipolar junction transistor Q2. The fourth resistor R4, the fifth resistor R5, the driving coil LS, and the first diode D1 are configured to alternatively drive the first bipolar junction transistor Q1 and the second bipolar junction transistor Q2. By alternatively driving the first bipolar junction transistor Q1 and the second bipolar junction transistor Q2, the resonant capacitor CT is resonated with the first transformer T1 to generate the current required by the lamps.

The dimming switch 270 includes N-type MOSFET M1 and the sixth resistor R6, and the gate terminal of the N-type MOSFET M1 is coupled to the ground 20 through the sixth resistor R6. According to an embodiment of the invention, when there is too much charge accumulated at the gate terminal of the N-type MOSFET M1, the sixth resistor R6 provides a discharging path. According to another embodiment of the invention, the sixth resistor R6 acts as an ESD device for the N-type MOSFET M1. The isolated dimming interface 240, the duty control circuit 250, and the dimming switch 270 will be described in detail in the following description. In the embodiment, the N-type MOSFET is illustrated as a switch herein, but not limited thereto. The switch could be a P-type MOSFET, a bipolar junction transistor, or any other type of transistor which could act as a switch.

Figure 3:
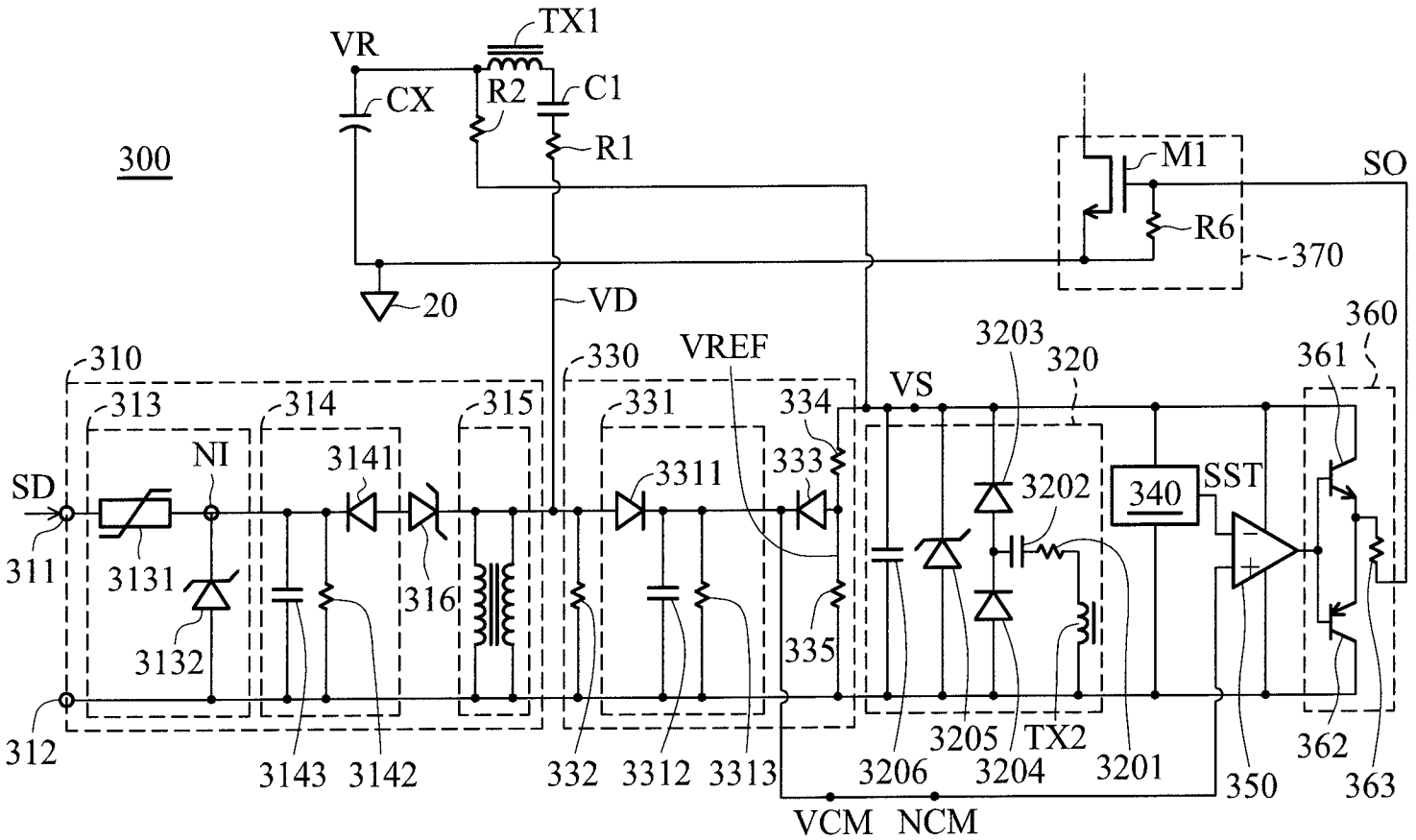
FIG. 3 is a schematic diagram of the dimming-control device in accordance with an embodiment of the invention.

FIG. 3 is a schematic diagram of the dimming-control device in accordance with an embodiment of the invention. As shown in FIG. 3, the dimming control device 300 in FIG. 3 illustrates the isolated dimming interface 240, the duty control circuit 250, and the dimming switch 270 in FIG. 2. According to an embodiment of the invention, the dimming control device 300 includes the isolated dimming interface 310, the voltage regulator 320, the clamp circuit 330, the triangle-wave generating circuit 340, the comparator 350, the switch driving circuit 360, and the dimming switch 370. According to an embodiment of the invention, the clamp circuit 330, the triangle-wave generating circuit 340, the comparator 350, and the switch driving circuit 360 form a duty control signal generator. According to an embodiment of the invention, the voltage regulator 320, the clamp circuit 330, the triangle-wave generating circuit 340, the comparator 350, and the switch driving circuit 360 correspond to the duty control circuit 250 in FIG. 2.

The isolated dimming interface 310 includes the first control terminal 311, the second control terminal 312, the miswiring protection device 313, the first half-wave rectifier 314, the isolated transformer 315, and the second zener diode 316, in which the first control terminal 311 and the second control terminal 312 receive the dimming signal SD. According to an embodiment of the invention, the dimming signal SD is a DC voltage ranging from 0V to 10V; according to another embodiment of the invention, the dimming signal SD is a resistive value of a resistive element. An embodiment that the dimming signal SD is a DC voltage ranging from 0V to 10V will be illustrated in the following description.

The miswiring protection device 313 includes the thermistor 3131 and the first zener diode 3132, in which the thermistor 3131 is PTC (Positive Temperature Coefficient). That is, once the first control terminal 311 and the second control terminal 312 receive an excessive voltage, the temperature of the thermistor 3131 would be increased such that the resistance of the thermistor 3131 is increased accordingly to limit the input current.

The first zener diode 3132 is configured to clamp the voltage value of the internal node NI under a predetermined voltage value. That is, when the voltage value of the internal node NI exceeds the predetermined voltage value, the first zener diode 3132 is immediately turned ON to prevent the voltage value of the internal node NI exceed the predetermined voltage value. According to an embodiment of the invention, the predetermined voltage value clamped by the first zener diode 3132 is 15V.

The first half-wave rectifier 314 includes the second diode 3141, the sixth capacitor 3143, and the seventh resistor 3144, which is configured to convert the received AC current to the DC voltage of the internal node NI. The isolated transformer 315 includes a primary side and a secondary side, in which the primary side is coupled to the clamp circuit 330 and the secondary side is coupled to the first half-wave rectifier 314. The isolated transformer 315 is configured to map the AC current received by the primary side to the secondary side and to map the impedance of the secondary side to the primary side. The second zener diode 316 is coupled between the first half-wave rectifier 314 and the isolated transformer 315, in which the function of the second zener diode 316 will be described in the following description. According to an embodiment of the invention, the isolated transformer 315 is configured to convert the dimming signal SD received by the secondary side and the voltage drop of the second zener diode 316 to the dimming voltage VD of the primary side.

The voltage regulator 320 includes the second coil TX2, the eighth resistor 3201, the seventh capacitor 3202, the third diode 3203, the fourth diode 3204, the third zener diode 3205, and the eighth capacitor 3206, in which the second coil TX2 is configured to sense the energy of the first coil TX1 and generates the DC supply voltage VS through the eighth resistor 3201, the seventh capacitor 3202, the third diode 3203, the fourth 3204, and the eighth capacitor 3206. The first coil TX1, the eighth resistor 3201, the seventh capacitor 3202, the third 3203, the fourth diode 3204, and the eighth capacitor 3206 are configured to serve as a charge pump. The third zener diode 3205 is configured to limit the DC supply voltage VS to no greater than the predetermined voltage value. According to an embodiment of the invention, the third zener diode 3205 is configured to limit the DC supply voltage VS to no greater than 15V.

The clamp circuit 330 includes the second half-wave rectifier 331, the ninth resistor 332, the fifth diode 333, the tenth resistor 334, and the eleventh resistor 335. The ninth resistor 332 is coupled to the primary side of the isolated transformer 315. The second half-wave rectifier 331 includes the sixth diode 3311, the ninth capacitor 3312, and the tenth diode 3313, which is configured to convert the dimming voltage VD of the primary side of the isolated transformer 315 to the DC dimming voltage which is provided to the comparison node NCM.

The reference voltage VREF is generated by DC supply voltage VS divided by the tenth resistor 334 and the eleventh resistor 335. When the comparison voltage VCM is less than the reference voltage VREF, the fifth diode 333 is then turned ON to provide the reference voltage VREF for the comparison node NCM, such that the minimum of the comparison voltage VCM is the reference voltage VREF minus the turn-on voltage of the fifth diode 333.

The comparator 350 is configured to compare the comparison voltage VCM and the triangle-wave signal SST generated by the triangle-wave generating circuit 340 to generate the duty control signal SDC. The duty control signal SDC has the duty cycle D, which is configured to control the period of the dimming switch 370 operating in the conductive state and the non-conductive state.

The switch driving circuit 360 includes the third bipolar junction transistor 361, the fourth bipolar junction transistor 362, and the thirteenth resistor 363, in which the switch driving circuit 360 generates the operation signal SO according to the duty control signal SDC. Since the comparator 350 has a poor driving capability, the switch driving circuit 360 is configured to precisely operate the dimming switch 370 in the conductive state or the non-conductive state. The thirteenth resistor 363 is configured to limit the output current of the third bipolar junction transistor 361 and the fourth bipolar junction transistor 362.

For the sake of explaining the invention in detail, the following description will be described referring to FIGS. 1-3 of the invention. When the dimming signal SD received by the isolated dimming interface 310 in FIG. 3 receives a 1V DC voltage of the dimming signal SD, a voltage across the secondary side of the isolated transformer 315 is a sum of the dimming signal SD, the second diode 3141, and the second zener diode 316.

According to an embodiment of the invention, the isolated transformer 315 is a 1-to-1 transformer, the turn-on voltage of the second diode 3141 and the sixth diode 3311 is 0.7V, the turn-on voltage of the second zener diode 316 is 3.9V. Therefore, when the dimming signal SD is 1V, the generated comparison voltage VCM is 4.9V. The comparator 350 compares the comparison voltage VCM with the triangle-wave signal SST to generate the duty control signal SDC, which is configured to control the N-type MOSFET M1 of the dimming switch 370 to be turned ON and OFF.

According to an embodiment of the invention, when the N-type MOSFET M1 is turned ON, the inverter circuit 260 in FIG. 2 generates the lamp current IL through the first transformer T1 to light the first lamp L1, the second lamp L2, the third lamp L3, and the fourth lamp L4 to generate the illumination lightness, in which the generated illumination lightness is proportional to the magnitude of the dimming signal SD.

Figure 4:
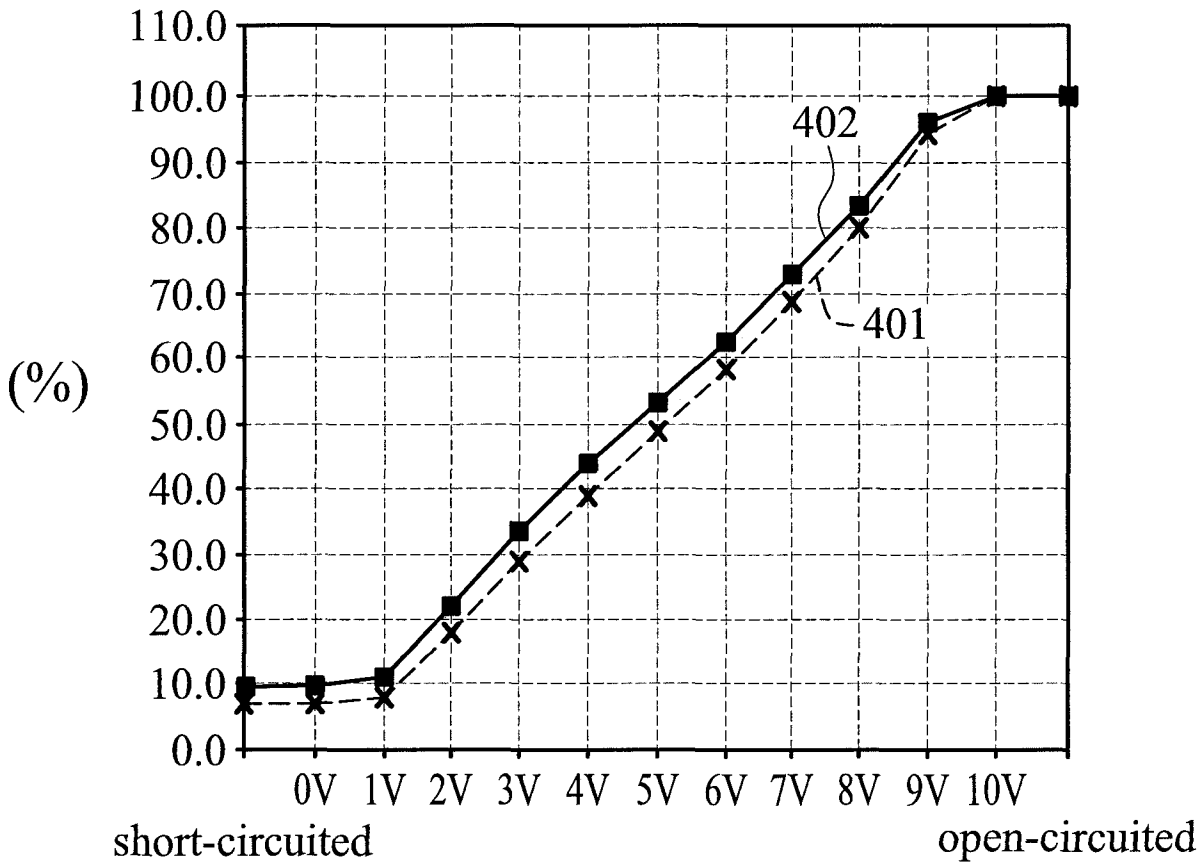
FIG. 4 is a dimming curve diagram in accordance with an embodiment of the invention.

FIG. 4 is a dimming curve diagram in accordance with an embodiment of the invention. As shown in FIG. 4, the X-axis of the dimming curve diagram 400 is the DC voltage value of the dimming signal SD, and the Y-axis is a percentage. The duty-cycle curve 401 represents the duty cycle D of the duty control signal SDC and the operation signal SO, and the lamp current curve 402 represents the average value of the lamp current IL.

According to an embodiment of the invention, the dimming signal SD is a DC voltage ranging from 0V to 10V, such that the duty cycle curve 401 is 100% when the dimming signal SD is 10V. That is, the dimming switch 270 is continuously operated in the conductive state. The lamp current 402 also corresponds to 100%, which means that the lamp current IL is continuously generated.

According to another embodiment of the invention, when the dimming signal SD is in the open state, the duty cycle curve 401 and the lamp current curve 402 both correspond to 100%. That is, the dimming switch 270 in FIG. 2 is turned ON continuously, and the lamp current IL is also continuously generated.

According to another embodiment of the invention, when the dimming signal SD is 1V, the duty cycle curve 401 and the lamp current curve 402 both correspond to 10%. That is, the dimming switch 270 in FIG. 2 is turned ON only for 10% period, and the dimming switch 270 is periodically operated in the conductive state. Therefore, the inverter circuit 260 in FIG. 2 generates the lamp current IL in the 10% period that the dimming switch 270 is turned ON, such that the average lamp current IL represented by the lamp current curve 402 is 10% of the lamp current IL that is continuously generated.

According to another embodiment of the invention, when dimming signal SD is 0V, the maximum voltage across the secondary side of the isolated transformer 315 in FIG. 3 is a sum of the dimming signal SD, the second diode 3141, and the second zener diode 316, which is 4.6V. According to an embodiment of the invention, the isolated transformer 315 is 1-to-1, such that the mapped dimming voltage VD is 4.6V.

According to an embodiment of the invention, the reference voltage VREF is 5.6V, such that the clamp circuit 330 provides the reference voltage VREF having greater voltage value for the comparison node NCM according to the sixth diode 3311 and the fifth diode 333. According to an embodiment of the invention, the 5.6V reference voltage VREF is exactly the maximum voltage across the secondary side when the dimming signal SD is 1V. Therefore, when the dimming signal SD is less than 1V, the reference voltage VREF is high enough to keep the average lamp current IL in 10%. According to another embodiment of the invention, the designer could adjust the reference voltage to set the minimum illumination brightness that is required.

According to an embodiment of the invention, the illumination brightness generated by the first lamp L1, the second lamp L2, the third lamp L3, and the fourth lamp L4 in FIG. 1 is proportional to the average lamp current IL. Therefore, the illumination brightness is also proportional to the duty control signal SDC and the duty cycle D of the operation signal SO.

According to another embodiment of the invention, when the first control terminal 311 and the second control terminal 312 in FIG. 3 are shorted, the dimming signal SD is 0V. That is, the illumination brightness generated by the first lamp L1, the second lamp L2, the third lamp L3, and the fourth lamp L4 in FIG. 1 is kept in the minimum brightness.

According to an embodiment of the invention, the dimming signal SD is a resistive value of a resistive element, and the illumination brightness generated by the first lamp L1, the second lamp L2, the third lamp L3, and the fourth lamp L4 in FIG. 1 is also proportional to the voltage across the resistive element.

Figure 5:
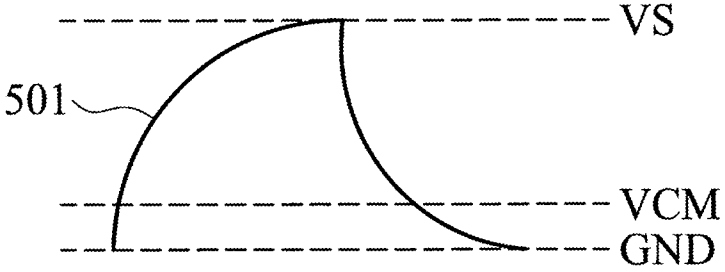
FIG. 5 is a diagram of the triangle signal SST in accordance with an embodiment of the invention.

FIG. 5 is a diagram of the triangle signal SST in accordance with an embodiment of the invention. According to an embodiment of the invention, the voltage curve 501 is the triangle-wave signal SST generated by charging and discharging a capacitor. Therefore, the maximum voltage level of the triangle-wave signal SST is the DC supply voltage VS, and the discharged minimum voltage level is the ground level GND of the ground 20.

According to an embodiment of the invention, the second zener diode 316 in FIG. 3 is configured to raise the minimum voltage level of the comparison voltage VCM, and the maximum voltage level of the comparison voltage VCM is also less than the DC supply voltage VS, such that the triangle-wave signal SST is in the linear region of the voltage signal generated by charging and discharging a capacitor and the illumination brightness is proportional to the duty cycle D.

According to an embodiment of the invention, when the DC supply voltage VS is 15V, the voltage drop of the second zener diode 316 is 3.9V, the dimming signal SD is ranging 0V to 10V, the reference voltage VREF is 5.6V, and the voltage drops of the second diode 3141, the sixth diode 3311, and the fifth diode 333 are both 0.7V, the comparison voltage VCM is ranging from 4.9V to 13.9V which is within the range from the DC supply voltage VS (i.e., 15V) to the ground level GND (i.e., 0V).

Figure 6:
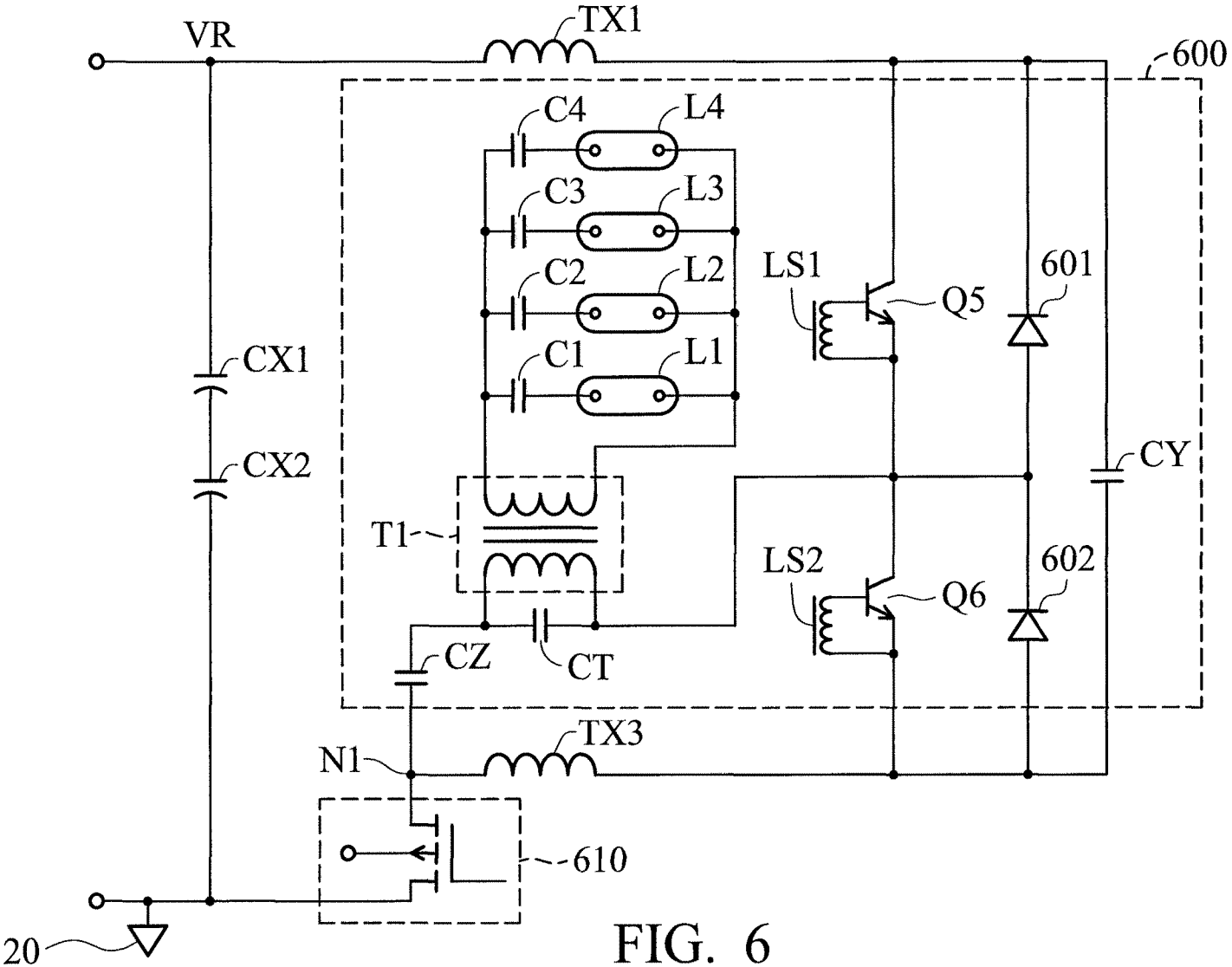
FIG. 6 is a schematic diagram of the inverter circuit in FIG. 2 in accordance with another embodiment of the invention.

FIG. 6 is a schematic diagram of the inverter circuit in FIG. 2 in accordance with another embodiment of the invention. According to another embodiment of the invention, the inverter circuit 260 in FIG. 2 is the half-bridge parallel resonant converter 600 which is coupled to the first node NI. The dimming switch 610 is coupled between the first node N1 and the ground terminal 20. As shown in FIG. 6, when the inverter circuit 260 in FIG. 2 is replaced by the half-bridge parallel resonant converter 600, the regulated capacitor CX in FIG. 2 is replaced by the first regulated capacitor CX1 and the second regulated capacitor CX2. In addition, the third coil TX3 is also included.

When the dimming switch 610 is operated in the conductive state, the half-bridge parallel resonant converter 600 generates the lamp current IL to the first lamp L1, the second lamp L2, the third lamp L3, and the fourth lamp L4 through the first transformer T1; when the dimming switch 610 is operated in the non-conductive state, the half-bridge parallel resonant converter 600 stops generating the lamp current IL. According to an embodiment of the invention, the user could adjust the turn-on period of the dimming switch 610 to achieve the purpose of dimming.

The half-bridge parallel resonant converter 600 includes the fifth bipolar junction transistor Q5, the sixth bipolar junction transistor Q6, the capacitor CY, the first coil LS1, the second coil LS2, the half-bridge capacitor CZ, the resonant capacitor CT, the first transformer T1, the first half-bridge diode 601, and the second half-bridge diode 602. The first coil LS1, the second coil LS2, and the half-bridge capacitor CZ are configured to alternatively drive the fifth bipolar junction transistor Q5 and the sixth bipolar junction transistor Q6. The resonant capacitor CT and the first transformer T1 are resonated to generate the current required by the lamps via alternatively switching the fifth bipolar junction transistor Q5 and the sixth bipolar junction transistor Q6 and alternatively turning ON the first half-bridge diode 601 and the second half-bridge diode 602.

A dimmable instant-start ballast with a wide dimming range is provided in the invention, in which the dimming range is as wide as 10% to 100% to overcome the technical barrier that the lamp could not be dimmed under 50%. In addition, the clamp circuit 330 is adopted in the dimming control device of the invention, such that the user could adjust the minimum achievable illumination brightness by adjusting the reference voltage VREF.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A dimmable instant-start ballast for a plurality of LED lamps and/or a plurality of fluorescent lamps, comprising:
   - an isolated dimming interface, receiving a dimming signal to generate a dimming voltage;
   - a duty control device, generating an operation signal according to the dimming voltage;
   - a dimming switch, periodically coupling a first node to a ground terminal according to the operation signal; and
   - an inverter circuit, receiving a rectified voltage and coupled to the first node, wherein the inverter circuit generates a lamp current to the LED lamps and/or the fluorescent lamps when the first node is coupled to the ground terminal, wherein the dimming switch periodically operates in an conductive state and an non-conductive state according to a duty cycle of the operation signal, wherein the first node is coupled to the ground terminal and the inverter circuit generates the lamp current when the dimming switch operates in the conductive state, wherein the first node is not coupled to the ground terminal and the inverter circuit does not generate the lamp current when the dimming switch operates in the non-conductive state, wherein the lamp current flows through the LED lamps and/or the fluorescent lamps to generate an illumination brightness, and wherein the illumination brightness is proportional to the duty cycle.

2. The dimmable instant-start ballast in claim 1, wherein the isolated dimming interface comprises:
   - two control terminals, receiving the dimming signal generated by an external dimming device;
   - a miswiring protection device, coupled to the control terminals and configured to provide miswiring protection;
   - a first half-wave rectifier, coupled to the miswiring protection device; and
   - an isolated transformer, comprising a primary side and a secondary side, wherein the primary side receives a first current, and the secondary side is coupled to the first half-wave rectifier, wherein the isolated transformer maps the first current of the primary side to the secondary side, and maps an impedance of the secondary side to the primary side to generate the dimming voltage at the primary side.

3. The dimmable instant-start ballast in claim 2, wherein the external dimming device is a DC voltage source, a resistive element, or a dimmer, wherein the dimming signal is a DC voltage value of the DC voltage source or a resistive value of the resistive element.

4. The dimmable instant-start ballast in claim 2, wherein the duty control device comprises:

a voltage regulator, generating a DC supply voltage according to the rectified voltage;

a duty control signal generator, receiving the DC supply voltage, comprising:

a triangle-wave generating circuit, configured to generate a triangle-wave signal;

a clamp circuit, rectifying the dimming voltage to be a DC dimming voltage and providing a maximal one between the DC dimming voltage and a reference voltage for a comparison node; and a comparator, comparing a voltage of the comparison node with the triangle-wave signal to generate a duty control signal; and a switch-driving circuit, receiving the DC supply voltage and generating the operation signal according to the duty control signal.

5. The dimmable instant-start ballast in claim 4, wherein the clamp circuit further comprises:

a second half-wave rectifier, converting the dimming voltage to the DC dimming voltage and providing the DC dimming voltage for the comparison node; and a diode, receiving the reference voltage, wherein the diode is turned ON to provide the reference voltage for the comparison node when the reference voltage exceeds the DC dimming voltage, such that the duty cycle is not less than a predetermined value, wherein the diode is turned OFF when the reference voltage does not exceed the DC dimming voltage.

6. The dimmable instant-start ballast in claim 4, wherein the isolated dimming interface further comprises:

a voltage-drop device, coupled between the first half-wave rectifier and the secondary side and configured to raise a voltage level of the DC dimming voltage, such that the illumination brightness is proportional to the dimming signal.

7. The dimmable instant-start ballast in claim 1, wherein the inverter circuit is a push-pull resonant converter or a half-bridge resonant converter.

8. The dimmable instant-start ballast in claim 1, further comprising a rectifier, wherein the rectifier receives an AC voltage to generate the rectified voltage.

9. A dimmable control device for controlling an inverter circuit to periodically generate a lamp current to a plurality of LED lamps and/or a plurality of fluorescent lamps, comprising:

an isolated dimming interface, receiving a dimming signal to generate a dimming voltage;

a voltage regulator, generating a DC supply voltage;

a duty control signal generator, receiving the DC supply voltage, comprising:

a triangle-wave generating circuit, generating a triangle-wave signal;

a clamp circuit, rectifying the dimming voltage to a DC dimming voltage and providing a maximal one between the DC dimming voltage and a reference voltage for a comparison node; and a comparator, comparing a voltage of the comparison node with the triangle-wave signal to generate a duty control signal;

a switch-driving circuit, receiving the DC supply voltage and generating an operation signal according to the duty control signal; and a dimming switch, periodically turning ON, according to the operation signal, to couple the inverter circuit to the ground terminal, such that the inverter circuit periodically generates the lamp current.

10. The dimming control device of claim 9, wherein the dimming switch periodically operates in a conductive state and an non-conductive state according to the operation signal, wherein the inverter circuit generates the lamp current when the dimming switch operates in the conductive state, and the inverter circuit does not generate the lamp current when the dimming switch operates in the non-conductive state, wherein the lamp current flows through the LED lamps and/or the fluorescent lamps to generate an illumination brightness, wherein the illumination brightness is proportional to a duty cycle of the operation signal.

11. The dimming control device of claim 9, wherein the isolated dimming interface comprises:

two control terminals, receiving the dimming signal generated by an external dimming device;

a miswiring protection device, coupled to the control terminals and configured to provide miswiring protection;

a first half-wave rectifier, coupled to the miswiring protection device; and an isolated transformer, comprising a primary side and a secondary side, wherein the primary side receives a first current, and the secondary side is coupled to the first half-wave rectifier, wherein the isolated transformer maps the first current of the primary side to the secondary side and maps an impedance of the secondary side to the primary side, wherein the dimming voltage is generated at the primary side.

12. The dimming control device of claim 11, wherein the external dimming device is a DC voltage source, a resistive element, or a dimmer, wherein the dimming signal is a DC voltage value of the DC voltage source or a resistive value of the resistive element.

13. The dimming control device of claim 11, wherein the clamp circuit further comprises:

a second half-wave rectifier, converting the dimming voltage to the DC dimming voltage and providing the DC dimming voltage for the comparison node; and a diode, receiving the reference voltage, wherein the diode is turned ON to provide the reference voltage for the comparison node when the reference voltage exceeds the DC dimming voltage, such that the duty cycle is not less than a predetermined value, wherein the diode is turned OFF when the reference voltage does not exceed the DC dimming voltage.

14. The dimming control device of claim 11, wherein the isolated dimming interface further comprises:

a voltage-drop device, coupled between the first half-wave rectifier and the secondary side and configured to raise a voltage level of the DC dimming voltage, such that the illumination brightness is proportional to the dimming signal.

* * * * *